US007649328B2

(12) United States Patent
Smirnov et al.

(10) Patent No.: US 7,649,328 B2
(45) Date of Patent: Jan. 19, 2010

(54) COMPACT HIGH-POWER PULSED TERAHERTZ SOURCE

(75) Inventors: Alexei V. Smirnov, Rancho Palos Verdes, CA (US); David U. L. Yu, Rancho Palos Verdes, CA (US)

(73) Assignee: DULY Research Inc.

( * ) Notice: Subject to any disclaimer, the term of this patent is extended or adjusted under 35 U.S.C. 154(b) by 222 days.

(21) Appl. No.: 11/999,754

(22) Filed: Dec. 7, 2007

(65) Prior Publication Data

US 2009/0146085 A1 Jun. 11, 2009

(51) Int. Cl.
*H05H 9/00* (2006.01)

(52) U.S. Cl. ..... 315/505

(58) Field of Classification Search ..... 315/505, 315/506, 507; 250/493.1
See application file for complete search history.

(56) References Cited

U.S. PATENT DOCUMENTS 6,844,688 B1 * 1/2005 Williams et al. ..... 315/505

* cited by examiner

*Primary Examiner*—Kiet T Nguyen

(57) ABSTRACT

A sub-mm wave source based on Cherenkov resonant radiation of a microbunched electron beam radiating coherently in a dielectric-loaded pipe. The microbunched electron beam is produced in a pulse photoinjector by illuminating a metal photocathode with sub-ps or multi-ps intensity-modulated laser beam with a beat wave or multiplexing at terahertz frequencies, the photoelectrons generated at the photocathode being accelerated by an electric field and sub-wavelength focused by magnetic field to propagate through a resonant radiator comprising a corrugated wall or smooth-wall metal capillary pipe internally coated with dielectric and attached to an antenna.

7 Claims, 11 Drawing Sheets

COMPACT HIGH-POWER PULSED TERAHERTZ SOURCE

BACKGROUND OF THE INVENTION

1. Field of the Invention

The invention generally relates to a coherent pulse source of a high power electromagnetic radiation produced by long-range wakefields induced in a slow-wave structure by a specially conditioned weakly relativistic electron beam produced by a photo gun. More particularly, the present invention is directed to providing a coherent high-power terahertz source via resonant Cherenkov radiation of a THz-modulated electron beam.

2. Description of the Prior Art

In the entire spectrum of available electromagnetic sources there is a gap between microwave and far infrared regions, where effective and compact, relatively inexpensive high-power sources are missing. A huge variety of applications in biology, medicine, chemistry, solid state physics, radio astronomy, homeland security, environment monitoring, microelectronics, plasma diagnostics, and industry are anticipating powerful terahertz (THz) sources for middle-size and small labs and businesses. The applications are related to fast processes, emerging time-domain spectroscopy (TDS), and imaging that require short THz pulses of high intensity. A heavy demand for terahertz technology also exists in the communications industry. Development of a powerful THz transmitter will result in a dramatic increase in the available bandwidth in wavelength-division-multiplexed communications networks.

Electron beams with time structures ranging typically from DC (as in electrostatic accelerator columns) to dozen(s) of picoseconds (as in photoinjectors) are capable of producing THz-radiation using e-beam-based or linac-driven sources such as Free Electron Lasers (FELs), Compton backscattering sources, traveling-wave tubes, klinotrons, and Smith-Purcell devices.

Currently, a few FELs are built to operate at THz frequencies. Typically such an FEL is driven by an electron accelerator and contains an undulator and an optical cavity. The first FEL facility to provide THz radiation to users has been the UCSB (University of California, Santa Barbara, Calif.)-FEL (0.3-0.8 mm wavelength). It is driven by a 6-MeV electrostatic accelerator with beam recirculation that delivers up to ~2 A beam current of relatively high quality (~10 mm-mrad emittance, and 0.3% energy spread). The maximum pulse power produced is 6 kW; this is short of the expected power of ~10 kW (in 1-20 μs pulse length) because of mode competition in the overmoded optical cavity (~5.4 m length) used to generate the radiation.

The largest FEL Facility at JLAB (Thomas Jefferson Laboratory) produces a broadband THz radiation with ϕW average and ~1 MW peak power.

To date the Novosibirsk (Russia) FEL is the most powerful coherent THz source operating at 0.12-0.24 mm wavelengths and 0.3% line width to deliver 0.4 kW average power and up to ~MW peak power and comprises a 20 m long optical cavity, and a long undulator driven by 40-50 MeV e-beam accelerated in a RF linac with energy recovery.

A super-radiant FEL does not have an optical cavity. The ENEA-Frascati FEL-CATS source operates in the 0.4-0.7 THz range with about 10% FWHM line width. The radiation beam has a pulsed structure composed of wave-packets in the 3 to 10 ps range, spaced at a repetition frequency of 3 GHz. A 5-microsecond long train of such pulses (macropulse) is generated and repeated at a rate of a few Hz. The power is 1.5 kW measured in the macropulse at 0.4 THz (corresponding to up to 8 kW peak in each micropulse).

Compact THz sources are basically CW devices of two types: vacuum and solid state. Vacuum devices use a non-relativistic low-power electron beam interacting with micro fabricated surfaces to generate diffraction radiation in an open geometry (e.g. Orotrons, Klinotrons, Smith-Purcell devices), or on a traveling wave in a closed system (e.g. the Backward Wave Oscillator (BWO) or Traveling Wave Tube (TWT). The typical power levels do not exceed a fraction of a Watt at terahertz frequencies. The power is typically limited by a low beam current density and a low degree of modulation occurring in the same limited interaction space.

Solid-state devices are low-power generators (or low-gain amplifiers integrated into a matrix array) based on Schottky varactor, high frequency Gunn, IMPATT or TUNNET diodes. The power produced in such devices is between tens and hundreds of milliwatts.

The most advanced solid-state device is the recently developed 1-4 THz laser based on lightly doped p-type germanium mono-crystals. The maximum emitted power depends on the crystal volume and can range from a few μW to several Watts, with duty cycles of up to 5%. Conventional gas lasers are line-tunable in the range 0.3 to 5 THz ($\lambda$=1000 to 60 μm) although with limited power (typically 100 mW for methanol).

Other known THz devices such as Quantum Cascade Lasers (QCD), laser-driven solid state emitters, and earlier Cherenkov FELs are also very limited in output power.

Thus, the problem with existing compact THz sources is low output power, whereas more powerful undulator-based FEL sources (having over kW peak power) are in national facilities that are extremely large and expensive. Undulator-based sources are very inefficient in the specific 0.3-1 mm wavelength range (between FEL and FEM).

SUMMARY OF THE INVENTION

The present invention overcomes the aforementioned problems related to a very low maximum power (for compact THz devices), or a large size and high cost (for FEL-type facilities) by providing a novel, compact solution for a high-power, sub-mm-wave generator using an electron beam. The invention provides a picosecond modulated, high-current-density photoinjector integrated with a THz radiator which eliminates the gap in robust, table-top THz pulse sources capable of generating high (kW to MW) peak power for a wide variety of practical applications.

According to the present invention, a (tens of ps) pulse of intensity-modulated (at THz frequencies) laser beam illuminates a metal photocathode and initiates a THz-modulated electron photoemission. The premodulated photocurrent is accelerated in the electron gun, focused, and then passed through a resonant dielectric-loaded THz-power radiator-extractor.

The principal advantages of the present invention when compared to known electron vacuum devices are as follows: i) radiation occurs at any beam current due to the absence of a threshold mechanism, ii) intensity modulation is provided at the very cathode and does not require extra space; iii) radiation steady state does not require a beam or laser pulse to be longer than the radiator filling time; and iv) the e-beam focusing is adjusted to minimize its size inside short radiator rather than optimize beam emittance as it occurs in undulator-based sources.

The present invention provides a method for generating a powerful terahertz radiation by passing a sub-wavelength focused, premodulated at THz frequencies electron beam through a short (~cm), small-aperture (~mm diameter) dielectric extractor.

The present invention also provides a method for space-charge-dominated beam transport through the radiator-extractor. For a RF photoinjector (or rf linac following the electron gun) a solenoidal magnetic system of the photoinjector and extractor works in the mode of maximized focusing rather than minimized emittance as it takes place with conventional emittance compensation technique and provides a sub-wavelength e-beam waist in the center of the radiator/extractor at substantial beam currents.

The present invention further provides a method for e-beam THz modulation by illuminating the emitting photocathode spot with laser beam(s) having resulting intensity modulated at the THz frequency. The laser intensity is modulated with a beatwave or multiplexing techniques. The beat wave technique is based on combining on the same cathode spot of two (or more) laser beams of comparable intensities but slightly different wavelengths to produce resulting beating at approximately the desired THz frequency. The multiplexing is a conventional technique for stretching the laser pulse and is based on optical split, recirculation and combining.

The present invention provides an apparatus for generating a terahertz wave using the following components:

- a laser-driven photoinjector supplied by a laser port(s) to produce a THz-modulated beam and to accelerate the beam keeping the longitudinal modulation;
- focusing system that confines the beam and focuses the beam for transportation via a radiator;
- collimator that protects the extractor from beam halo and damage caused by beam misalignment;
- slow-wave dielectric extractor that converts coherently kinetic energy of the premodulated and accelerated beam into the guided, resonant electromagnetic radiation;
- output system that couples the electromagnetic radiation out of the dielectric extractor and vacuum enclosure of the devices (the system can be represented by an antenna or an output waveguide and output window);
- beam collector that dumps the electron beam downstream the extractor and protects the window or THz user facility from the energetic electrons; and
- steering magnetic system that provides additional beam focusing and alignment in the extractor and defocusing in the collector.

Picosecond or sub-ps modulation of the photoemission with correspondingly conditioned laser beam and replacing the conventional undulator with a small dielectric power extractor results in a number of important benefits compared to linac-driven FEL/FEM in the sub-mm range of wavelengths. These benefits and features include the following:

1. For the wavelengths of interest (~0.34 mm), the dielectric extractor can produce megawatts in peak power, something that is difficult for a single-pass FEL to do at these wavelengths.
2. The injector is simpler due to much lower energy of the electron beam; a weakly relativistic (<10 MeV) beam can be used (instead of the usual >10 MeV energies).
3. The source of the present invention is a compact, table-top system, with no lengthy optical cavity or undulator. The system does not produce neutrons, so it has better radiation safety with much less bulky (local) shielding.
4. The dielectric or corrugated wall metal radiator is robust, much simpler, cheaper, and smaller (1 mm-3 cm) than the undulator (30 cm-3 m).
5. The short dielectric tube does not require sub-sectioning and so the known problem of joint connection is avoided.
6. Unlike an FEL having distributed interaction in the undulator, the source of the present invention is less sensitive to the e-beam emittance and admits beam over-focusing.
7. THz frequency tuning/modulation can be accomplished by changing the electron beam energy (<5-10 MeV), phase of accelerating RF (bunch length depends on phase and RF power), or the laser beat wave frequency.
8. The radiation phase is synchronizable by means of the laser system electronics and due to the mechanism of stimulated resonant Cherenkov radiation, which is described completely analytically, including eigen-modes and the observed transient reflections and input beam modulation.
9. The source has lower total cost.

DESCRIPTION OF THE DRAWINGS

For a better understanding of the present invention as well as other objects and further features thereof, reference is made to the following description which is to be read in conjunction with the accompanying drawing wherein.

DETAILED DESCRIPTION OF THE INVENTION

The present invention generates a coherent pulse source having a center frequency between 0.5 and 1 terahertz, or equivalently, having a wavelength between 0.6 and 0.3 millimeters. The invention may be used in many applications including, but not limited to, security (e.g., remote inspection of packages enclosed in plastic, cardboard or fabric), mine detection (e.g. land surface metal-detector/imager in arid areas), quality control of semiconductor logic chips (e.g., remote inspection of metal content therein), and quality control of agricultural products (e.g., remote inspection of water content therein).

Figure 1:
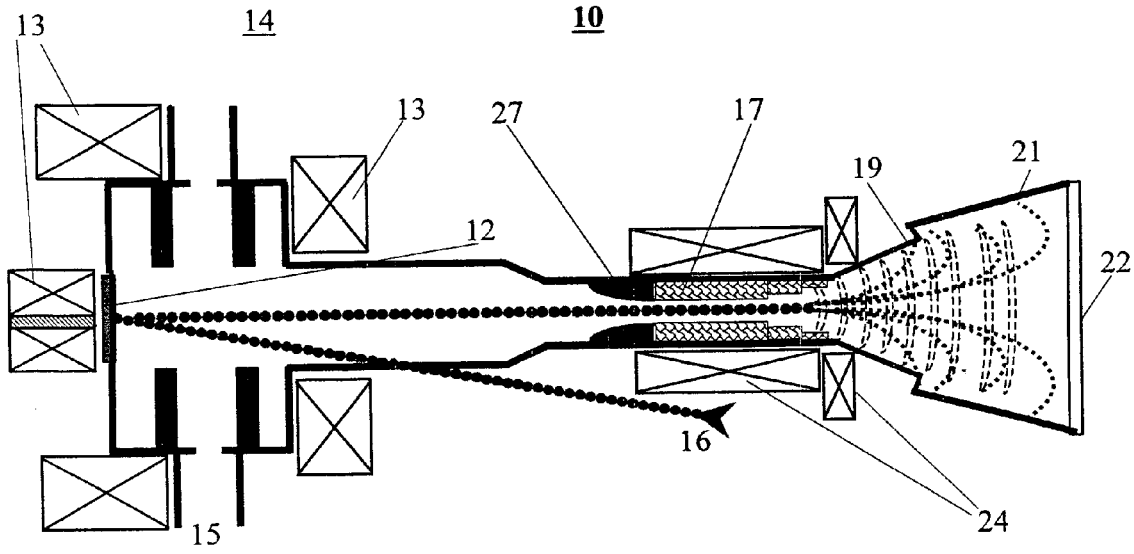
FIG. 1 shows a schematic of a terahertz source driven by a pulsed RF photoinjector ignited by a pulsed laser source having THz intensity modulation according to the present invention.
Figure 2:
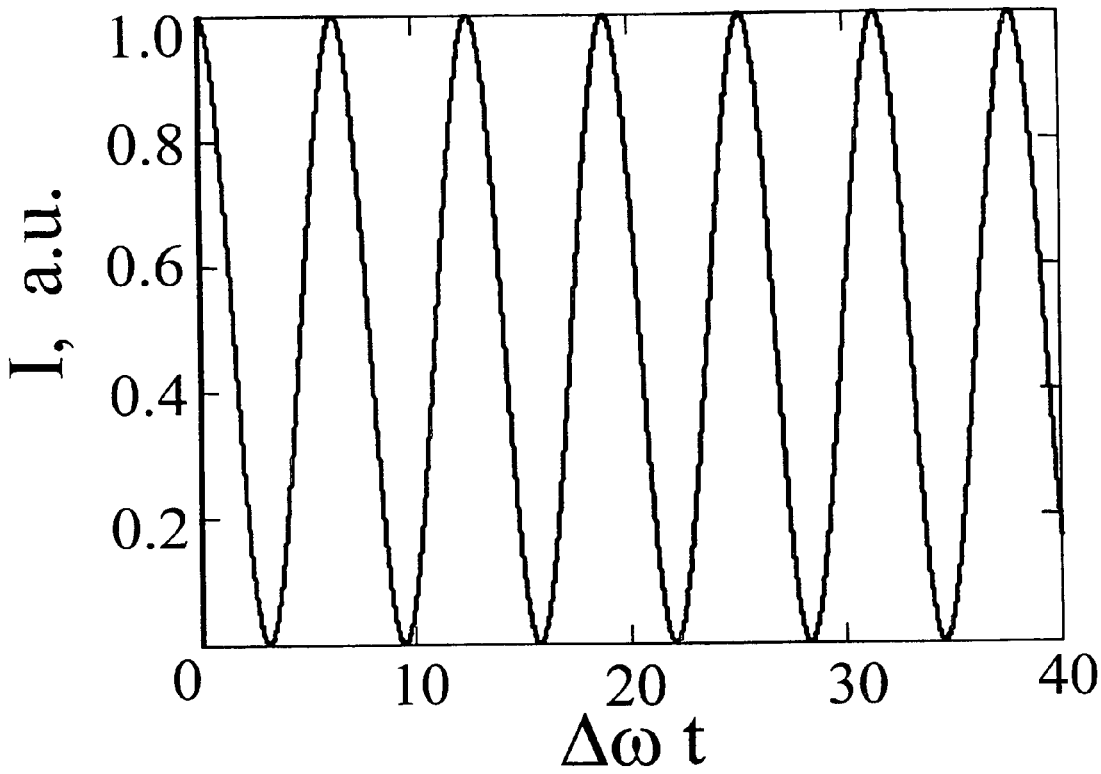
FIG. 2 shows two-wave beating of laser intensity obtained with frequency-tunable laser and that gives 0.5 theoretical maximum for frequency spectrum produced in a frequency-tunable laser system for the microbunch form factor.

FIG. 1 provides an illustrative pulsed terahertz generation system 10 according to the present invention (left hand portion of FIG. 1 is commonly referred to as a RF Photoinjector having a vacuum port 15). A metal photocathode 12 having work function below laser quanta energy is placed into an accelerating RF cavity 14. A modulated laser beam (or beams) 16 illuminate(s) the same cathode spot and triggers electron photoemission into the vacuum volume of the RF accelerator. The laser system is employed in a beatwave or multiplexed mode and delivers a multi-ps length, intensity-modulated laser beam. Emitted photocurrent is equal to the product of the cathode quantum efficiency and laser quanta rate flow. Due to a fast (<<ps) response time of a metal photocathode, e.g., copper or magnesium, the photoemission is proportional to the resulting laser intensity and repeats its temporal profile in presence of sufficient extracting electric field.

The following sets forth the functions of the components shown in FIG. 1:

A. Laser

1. Provides photoemission of electrons from the cathode.
2. Provides temporal~THz modulation of the laser intensity or sub-ps single pulse.
3. Provides e-beam alignment with laser optics alignment (for practical operation/adjustment).
4. Phasing/timing of the electron beam for proper/optimal acceleration and THz radiation.

B. Electron Gun (12,14)

1. e-beam emission—inertionless escape from the cathode 12 stimulated by laser.
2. e-beam acceleration in the cavity 14 and confinement in longitudinal phase space.

C. Focusing System (Solenoids) (13, 24)

1. e-beam confinement in transverse phase space upstream the channel.
2. e-beam transport/focusing with minimal waist dimension to let the beam pass via the tiny capillary channel with minimal interception/losses.
3. beam deposition on the (collector and, in part, window) walls to separate/waste the electron from the THz beam.

D. Extractor/Radiator (17)

1. Provides coherent interaction of slow-wave eigenmodes induced by the electron beam in the channel and transfers part of the energy of the electrons into the THz energy of the TM01 fundamental mode.
2. Provides low-loss transport of the most of the free electrons through the extractor aperture.
3. Provides single-mode launching, propagation and confinement of the THz radiation beam.

E. Collector (21)

1. Provides collection of the defocused electron downstream the extractor.

F. Antenna (19)

1. Matches the TM01 fundamental mode in the closed boundary of the extractor with the free-space fundamental Gaussian-Hermitte mode to extract (couple out) the THz radiation with minimal return loss.
2. Provides sufficient directivity and radiation (mode transform) efficiency.

G. THz Output Window (22)

1. Provides vacuum sealing of the device and low-loss extraction of the THz radiation out of the volume in to the surrounding medium (air).
2. May provide also additional focusing/lensing of the THz radiation if necessary.
3. May provide additional collection or extraction of the electron beam if necessary (in addition/instead of the collector 21).

H. Coils/Magnets (24)

Coils/magnets 24 steer and defocus the electron beam 14.

I. Collimator (27)

Collimator 27 reduces the electron beam 14 to a desired transverse size to protect extractor dielectric.

J. Accelerating RF Cavity (14)

Provides effective interaction of electron beam with microwaves by means of beam synchronized capture and resonant acceleration. The cavity can be combined with the cathode and electron gun. Typically consists of cylindrical cavity loaded by disks, RF coupler (or RF port), and vacuum port(s) 15.

Figure 3:
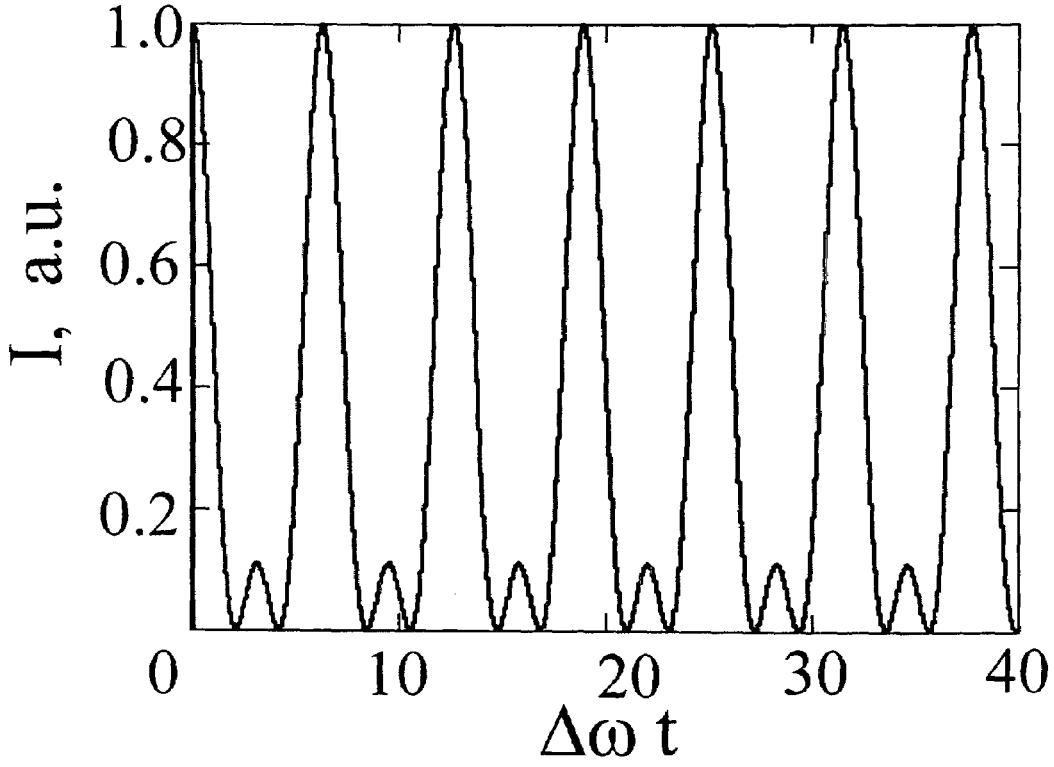
FIG. 3 shows laser intensity modulated with perfect three-wave-beating (on the left) and produced with three laser lines and that gives 0.67 theoretical maximum for microbunch form factor.

The photoemission is modulated with a beat-wave or multiplexing technique. The beat-wave modulation of laser intensity results from a superposition of two or more coherent electromagnetic beams. Laser beam coherence and superposition lead to resulting intensity beating on the same cathode spot as it is shown in FIG. 3. The main beating frequency of the intensity modulation is equal to frequency difference between the adjacent laser lines. Simultaneously it determines the desired frequency. In the example for a ~248 nm laser beam wavelength the relative frequency shift is about 0.15% to produce a ~1 THz radiation. Two (or more) laser lines with ~THz frequency difference can be created in two ways. One way is usage of continuously tunable lasers with appropriate THz frequency shift (line separation). It can be, for example, Ti:Sapphire or LiF:$F_2$+** color center lasers pumped by pulsed, frequency-doubled, Nd-doped laser or Alexandrite laser. Another technique employs passive nonlinear optics with usage a single, but intense laser to pump a Raman heterostructured material with a THz Stokes shift and generate multiple Stokes waves beating at the stoke shift.

Figure 4:
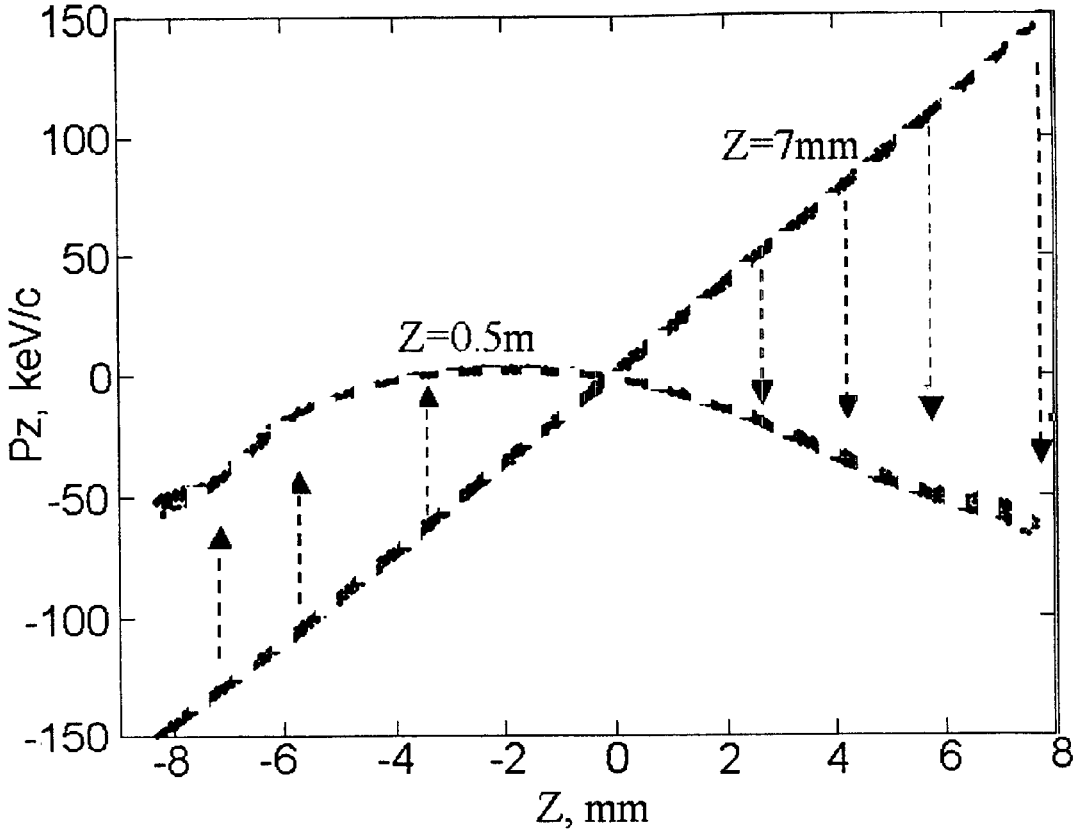
FIG. 4 illustrates the microbunched longitudinal phase space occupied by a beam simulated near the cathode (Z=7 mm) and downstream the radiator (Z=0.5 m)

Laser pulse multiplexing uses the sub-ps drive laser pulse, either actively, using an optical ring where the pulse is trapped, conditioned, circulated, and may be re-amplified, or passively, where the pulse is circulated into a confocal mirror system; e.g., with a periscope to rotate the polarization of the input pulse and a broadband thin film polarizer that allows for up to 20 passes at the focal interaction point. Such a scheme has been used in a Compton backscattering scheme, where multiplexing is necessary to enhance average brightness of the Compton source. In the Compton source scheme tested in LLNL a 7-pass confocal system producing 14 pulses at the interaction point have been used. Thus multiplexing can give a train of about a dozen (or more) of Gaussian optical bursts up to 24 μJ each with conventional optics by splitting and subsequent sub-delaying of the 30 fs, 300 μJ pulse from a commercial laser. The accuracy of the timing is not important as long as the time interval between the individual sub-ps bursts exceeds the drain time for the THz capillary extractor. In the microbunched, coherent mode of radiation the time interval has to be an integer of the period of the THz resonant frequency. Thus a premodulated electron beam with ps-scale or sub-ps microbunches is further accelerated in RF accelerating cell or cells. The entire emitted macro bunch has to be much shorter then the RF period to avoid strong distortion of the THz pre-modulation. FIG. 4 shows that the accelerated relativistic bunch is still modulated downstream the RF accelerating unit in spite of some distortions caused by the phase-space transformation of the 3D beam dynamics during the acceleration.

Figure 5:
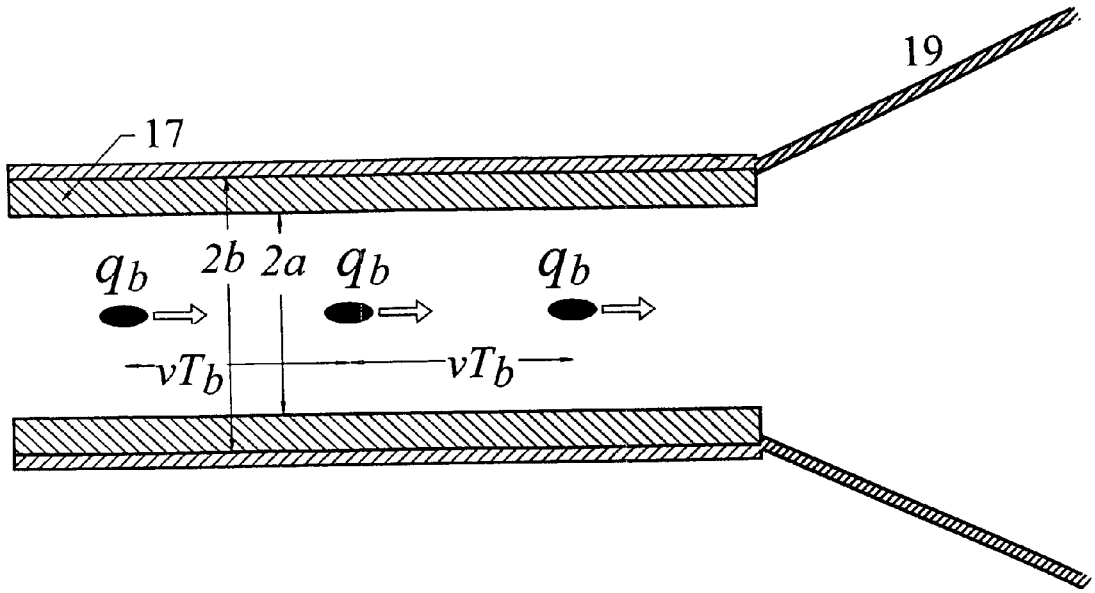
FIG. 5 is a schematic diagram of the dielectric extractor.

After being accelerated the pre-modulated and focused electron beam enters the slow-wave resonant extractor. The extractor is a traveling-wave, Cherenkov-type device having small reflections near the operating terahertz frequency. As it is shown in FIG. 5, the exhauster is a metal tube periodically corrugated or internally coated with dielectric of certain thickness depending on the central frequency of the radiation (2*a* is the aperture bore diameter, 2*b*-2*a* is the dielectric thickness, Tb is the period of modulation determined by the f heat or multiplexing frequency). The resonant Cherenkov radiation frequency f is defined from the following relationship:

$$\omega \equiv 2\pi f = h(\omega)\cdot V$$

where ν is the accelerated beam velocity, and h(ω) is the waveguide wavenumber as a function of frequency (i.e. dispersion function of the slow-wave extractor system). For example, for copper cylinder with ID=2b=0.6588 mm coated with Teflon having dielectric constant ∈=2.08 and thickness 2(*b*-*a*)=0.0344 mm the resonant radiation frequency is f=0.97 THz for a 2 MeV kinetic energy beam. This extractor waveguide possesses high group velocity $\beta_{gr}$=0.8, high shunt impedance r/Q=12.4 kΩ/m, and low enough attenuation $\alpha$=0.0244 $cm^{-1}$ (assuming 0.0004 loss tangent for Teflon at that frequency).

Figure 6:
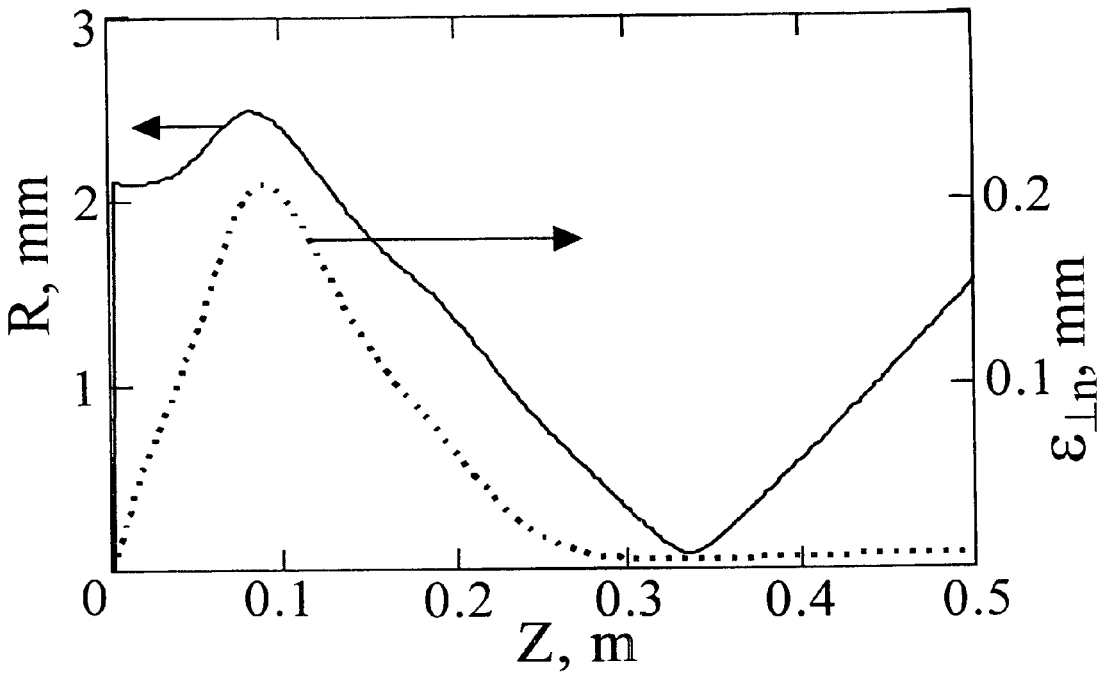
FIG. 6 shows the electron beam rms radius (mm, solid curve) and transverse emittance (dashed line) simulated with particle-in-cell code as a function of the distance from the cathode.

The radiator aperture has to be small enough to maximize the power output. In our example the aperture radius a=0.295 mm is less than the radiation wavelength. To transport the beam through the aperture it has to be focused. In our example it is provided by solenoidal magnetic system (see FIG. 1) with peak on-axis magnetic field 1.26 kGs. The center of the extractor is located at the waist of the electron beam focus as it is shown in FIG. 6. Since the beam waist rms radius ~90 μm is less than ⅓$^{rd}$ of the aperture radius, the beam losses are negligible. Additionally the dielectric can be protected with a collimator which is a metal iris located upstream the radiator (see FIG. 1).

The power radiated by the beam inside the dielectric tube is given by the following formula:

$$P = \frac{\omega}{4}\frac{r}{Q}\frac{1}{|v_{gr}|}\left|I\Phi L\frac{1-e^{-\alpha L(1+ia_s)}}{\alpha L(1+ia_s)}\right|^2, \tag{1}$$

where $$\Phi = \frac{1}{q}\int_l \frac{dq}{dz}(z')\exp\left(-i\frac{kz'}{\beta}\left(1-\frac{i/2Q}{1-\beta_{gr}/\beta}\right)\right)dz'$$

is the bunch formfactor, q is the microbunch charge, ω=2πf=h(ω)ν is the resonant frequency, β=ν/c, k=ω/c, $2Q|\beta-\beta_{gr}|>>1$, $[L(\beta_{gr}^{-1}-\beta^{-1})f_b/c]^2>>1$, $a_s=2Q(f/f_b-1)(1-\beta_{gr}/\beta)$ is the generalized detuning, $f_b=1/T_b$ is the final frequency of beam microbunching produced initially by wave beating or multiplexing at the cathode; L is the interaction length in the extractor, and $\alpha=\pi f/Q\nu_{gr}$ is the attenuation constant.

Figure 7:
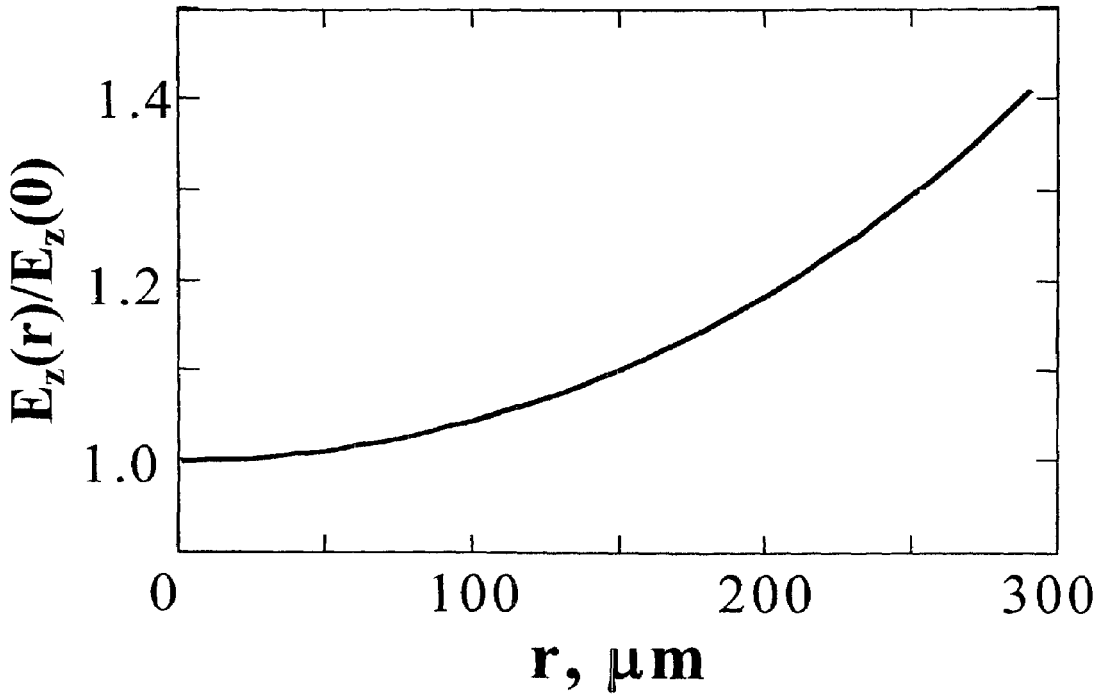
FIG. 7 shows field profile across dielectric extractor aperture at beam velocity V=0.98 C.

Formula (1) gives the power neglecting finite beam radius. Since the electric field increases with radius at ω/h<c (see FIG. 7) the actual power will be higher than given by (1). The two-wave beating ideally gives Φ=0.5 formfactor, therefore the maximum THz power radiated by a 19.2 A beam (0.5 nC charge at 26 ps output pulse length) is limited by 0.72 MW.

Another example is 59 A beam at 3.2 nC charge, 26 ps laser pulse, and ~54 ps output beam pulse length see FIG. 6) Coherence distortions caused by acceleration at high peak current are included here in the reduced formfactor Φ=0.15. According to (1) the power induced in the tube is ~0.5 MW.

Figure 8:
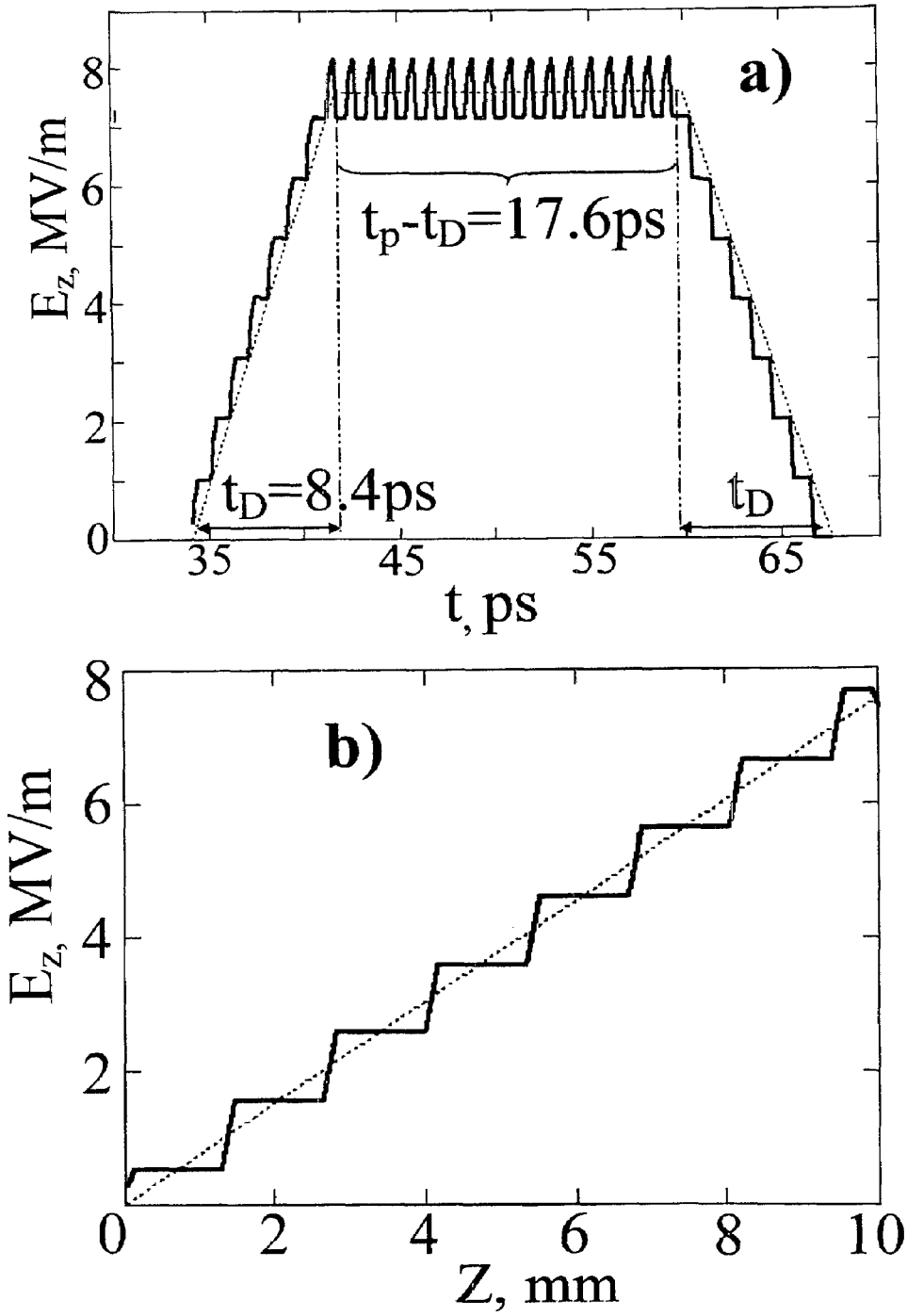
FIGS. 8(*a*) and (*b*) shows temporal and spatial waveform envelopes calculated for the longitudinal electric field induced in the extractor by a uniformly micro bunched beam.
Figure 9:
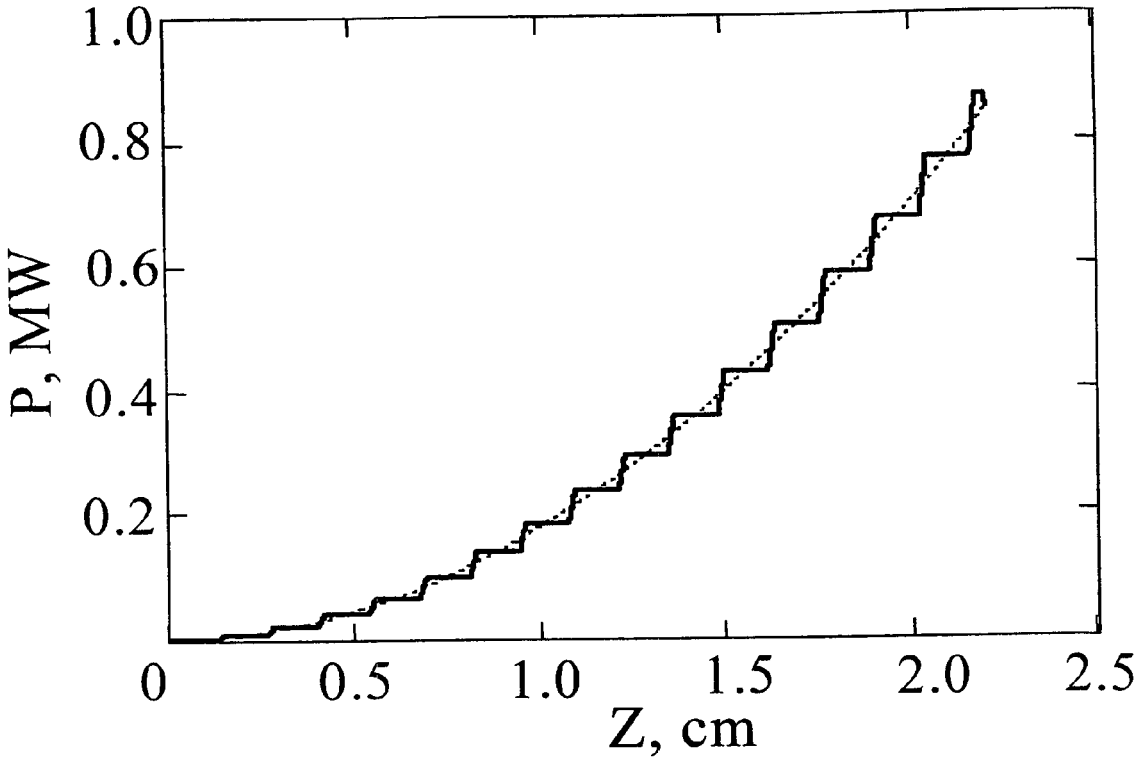
FIG. 9 shows saturated power as a function of interaction length.

The flat-top length of the trapezoidal pulse (see FIG. 8*a*) is equal to beam duration $t_P$ subtracted by drain time $t_D$, which is defined, in turn, as filling time $t_f$ minus time-of-flight of the radiator $\tau_o$=L/ν. Since the radiation is coherent the field amplitude is a linear function along the dielectric extractor (see FIG. 8*b*) and hence the output power is a quadratic function of the interaction length represented by the regular part of the dielectric-loaded tube (see FIG. 8*b*).

The frequency of the coherent radiation is determined by resonance between e-beam velocity ν and phase velocity (ν=ω/h); therefore it can be tuned by changing beam energy. The detuning sensitivity is given by $df/fd\gamma=(\gamma\beta)^{-3}/(1-\beta/\beta_{gr})$, that yields 78 MHz/kV for our example.

In the intermediate mode using train of independent microbunches when $T_b \geqq t_D$, where $t_D=L(\beta_{gr}^{-1}-\beta^{-1})/c$ is the drain time, the THz radiation is produced at the same peak power as that for a single microbunch with the same shape and charge per microbunch. Hence the interaction space can be made shorter without diminishing the peak power to produce wider bandwidth radiation required some applications. The generated pulse duration from each microbunch is equal to $t_D$ in this mode of operation. If a beat-wave modulation or train of multiplexed sub-ps laser pulses is used in this case at $T_b \geqq t_D$, the timing of individual laser pulses is no longer to be resonant with the radiation frequency; as it produces just series of synchronized short bursts of the same peak power. Or a single sub-ps laser pulse can be used. The peak power and radiated energy produced in this case are given by formula (2).

$$P_{1b} = \frac{\omega}{4}\frac{r}{Q}|v_{gr}|\cdot\left|\frac{q\Phi}{1-\beta_{gr}/\beta}\right|^2,$$

and $$W_{1b} = \frac{\omega}{4}\frac{rL}{Q}\cdot\frac{|q\Phi|^2}{|1-\beta_{gr}/\beta|}$$

Formula (2) is confirmed experimentally very well (see, e.g, [1] and [2]). Higher group velocity enhances power (2) apart from coherent field superposition in a "long" structure with a bunch train (see Eqn. (1)).

For single microbunch example, the parameters above the microbunch charge is assumed q=61 pC. Assuming Φ=0.5 formfactor for the sub-ps microbunch charge that passes ~1 mm short capillary channel (disk) of the same cross-section as above. Then from formula (2) we have $P_{1b}$≈190 kW peak power with ~0.7 ps duration and ~0.13 μJ energy, which is still very substantial compared to superradiant THz FEL facilities. In just a 1 mm short capillary (or slab) this peak power will be produced in intrinsically synchronized, wide bandwidth pulses.

The performance in this ultra-short pulse mode is a somewhat similar to transition radiation [3] or laser wakefield scheme [4], but possesses narrower radiation spectrum which is still resonant and does not employ such a high beam energies (70-100 MeV in BNL and LBL experiments). The dispersion properties of the dielectric extractor provide additional control over the spectral characteristics of the emitted radiation.

Figure 10:
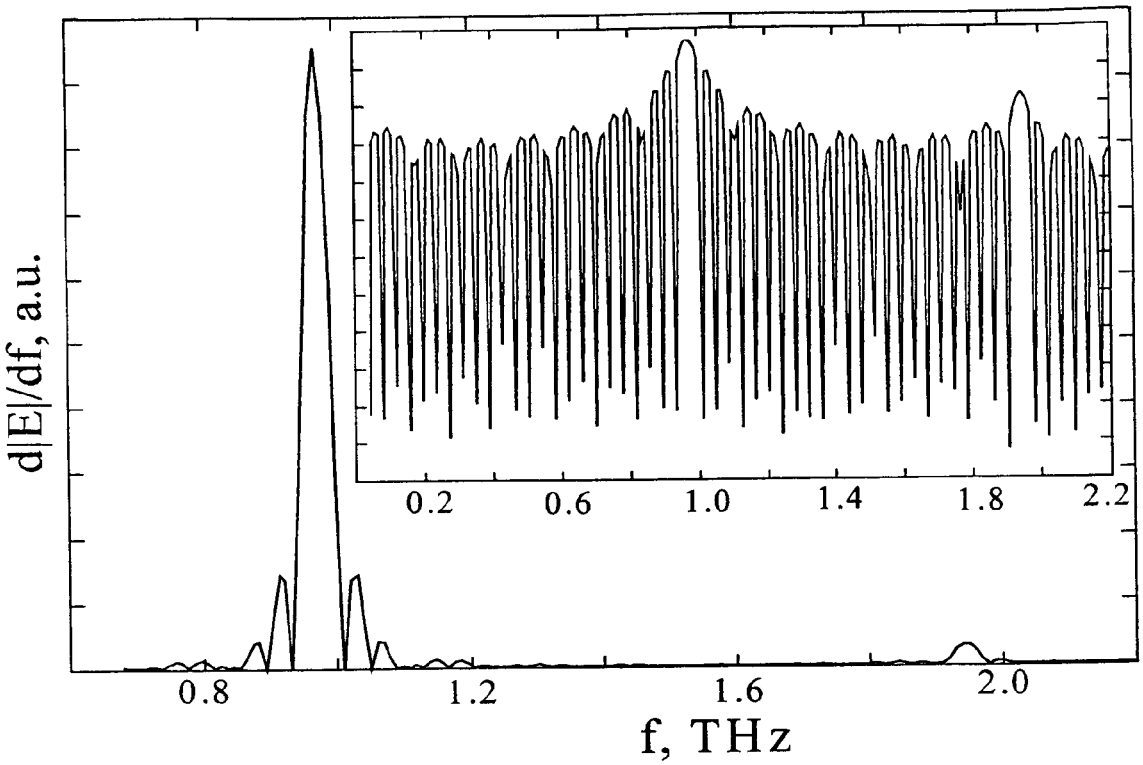
FIG. 10 shows frequency spectrum of a field (see FIG. 8)
Figure 11:
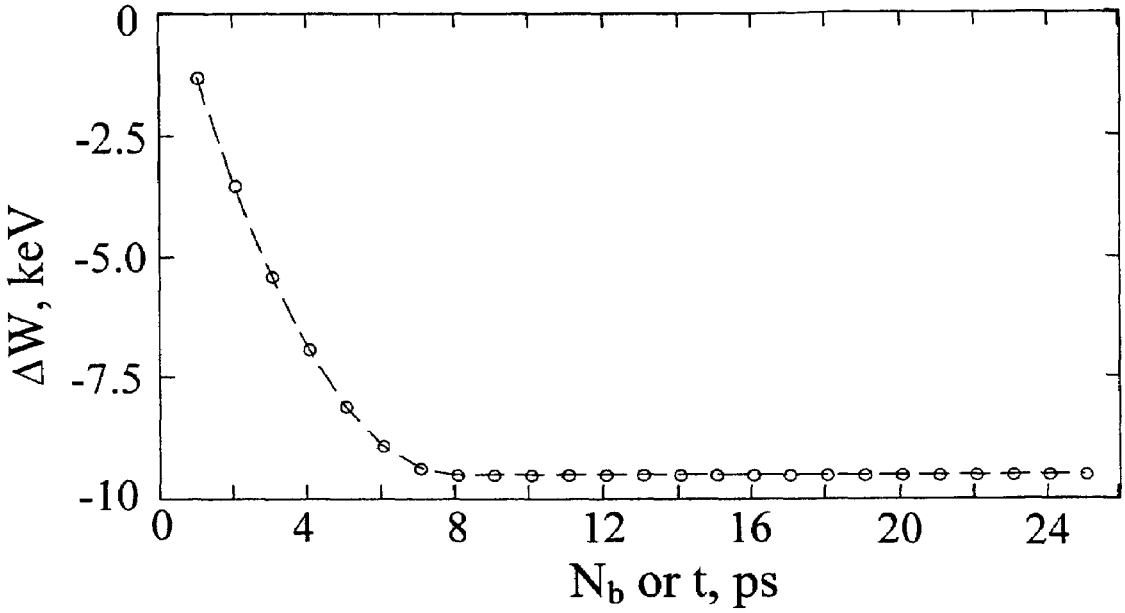
FIG. 11 shows the temporal profile of the beam kinetic energy change along the pulse.

The dielectric extractor comprises horn antenna 19 and collector 20 and dielectric window 22 shown in FIG. 1. The metallic antenna 19 is sufficiently matched with the dielectric extractor at central frequency to couple out the radiation within the central peak of the spectrum given in FIG. 10. The window is made from a low-loss material such as polyethylene, polyamide or Teflon and provides coupling out of the radiation from vacuum volume of the radiator integrated with the electron gun. The periphery of the space between the dielectric extractor and the window serves simultaneously as a collector to dump the beam. The beam deposition on the metallic wall of the horn (collector) can be enhanced with special steering (defocusing) magnets/coils 24 to protect the THz window from the harmful affect of the e-beam especially at high repetition rates. The e-beam kinetic energy decrease is shown in FIG. 11 and gives about 0.5% electronic efficiency in steady state for 2 MeV kinetic energy of the accelerated beam.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A method for generating a terahertz band electromagnetic radiation using a vacuum electronics device with a built-in radiator driven by a microbunched electron beam, the method comprising the steps of:

generating pulsed laser beams with sub-picosecond time structure illuminating a photocathode;

generating an electron beam repeating the sub-picosecond time structure of the laser beam by means of laser-stimulated photoemission;

accelerating, focusing and transporting said electron beam through a radiator channel;

converting part of the accelerated beam kinetic energy into the terahertz electromagnetic slow wave in the radiator channel;

dumping the electron beam in a collector and extracting the terahertz radiation from the vacuum volume through a window.

2. The method of claim 1 in which the terahertz radiation produced in the radiator channel is extracted with integrated antenna and propagates freely in an open, unbounded space.

3. The method of claim 1 in which a capillary dielectric coated channel is used as the THz radiator.

4. The method of claim 1 further including generation of premodulated laser beams having two or more different frequency lines resulting in intensity beating at the photocathode at terahertz frequencies and generating a correspondingly modulated photo-electron beam and synchronized at terahertz frequencies that produces a terahertz radiation in the radiator.

5. The method of claim 1 further including generating of multi-picosecond laser beams comprising a train of sub-picosecond laser pulses by means of splitting or multiplexing of a single sub-picosecond laser pulse and generating a corresponding multi-picosecond train of photoelectron microbunches that produce terahertz radiation in the radiator.

6. The method of claim 1 further including generating of a sub-picosecond laser beam, generating a corresponding sub-picosecond microbunch that produces terahertz radiation in the radiator.

7. An apparatus for generating a terahertz radiation using a premodulated or ultrashort electron beam produced in a photoinjector, the apparatus comprising: a laser-driven photoelectron gun, a dielectric-coated or corrugated-wall hollow channel made in metal, an antenna, electron beam collector, magnet, and output window.

* * * * *